US005765854A

United States Patent [19]

Moore et al.

[11] Patent Number: 5,765,854

[45] Date of Patent: Jun. 16, 1998

[54] BINDING MOUNTING SYSTEM

[76] Inventors: Lonny J. Moore; Adam C. Moore, both of 719 Gaylord, Denver, Colo. 80206

[21] Appl. No.: 546,711

[22] Filed: Oct. 23, 1995

[51] Int. Cl.[6] ..... A63C 9/18

[52] U.S. Cl. ..... 280/618; 280/14.2; 280/633

[58] Field of Search ..... 280/607, 618, 280/617, 620, 633, 636, 14.2; 441/70

[56] References Cited

U.S. PATENT DOCUMENTS

| | | | |
|---|---|---|---|
| 2,740,972 | 4/1956 | Taylor | 441/70 |
| 3,203,016 | 8/1965 | Miller et al. | 441/70 |
| 3,937,481 | 2/1976 | Koleda | 280/618 |
| 4,022,491 | 5/1977 | Powell . | |
| 4,310,170 | 1/1982 | Linecker . | |
| 4,674,765 | 6/1987 | Powell . | |
| 4,779,890 | 10/1988 | Mugnier . | |
| 4,792,155 | 12/1988 | Besnier | 280/14.2 |
| 4,869,522 | 9/1989 | Besnier et al. | 280/14.2 |
| 4,995,631 | 2/1991 | Hunter . | |
| 5,054,807 | 10/1991 | Fauret | 280/607 |
| 5,096,217 | 3/1992 | Hunter . | |
| 5,232,241 | 8/1993 | Knott et al. . | |
| 5,261,689 | 11/1993 | Carpenter et al. . | |
| 5,273,305 | 12/1993 | Erdei et al. . | |
| 5,344,176 | 9/1994 | Trimble | 280/602 |
| 5,354,088 | 10/1994 | Vetter et al. . | |
| 5,480,175 | 1/1996 | Astier et al. | 280/607 |

FOREIGN PATENT DOCUMENTS

| | | | |
|---|---|---|---|
| 2069372 | 11/1993 | Canada | 280/14.2 |
| 929149 | 12/1947 | France | 280/14.2 |
| 2 645 034 A1 | 3/1989 | France . | |
| 2153514 | 5/1973 | Germany | 280/14.2 |
| 40 20 873 A1 | 9/1992 | Germany . | |

*Primary Examiner*—Brian L. Johnson
*Assistant Examiner*—Avraham Lerner
*Attorney, Agent, or Firm*—Lee R. Osman; John R. Wahl; Holland & Hart LLP

[57] ABSTRACT

A binding mounting system for releasably mounting bindings on a ski apparatus comprises a binding plate having a front end and rear end, a first mounting structure positioned adjacent to the front end of the binding plate, a second mounting structure positioned adjacent to the rear end of the binding plate. The first mounting structure is positioned coextensive with a front mounting location of the ski apparatus, and the second mounting structure is positioned coextensive with a rear mounting location of the ski apparatus. The first mounting structure is releasably attachable to the front mounting location, and the second mounting structure is releasably attachable to the rear mounting location. Several varieties of mounting structures are used to encompass the ski apparatus mounting techniques.

11 Claims, 12 Drawing Sheets

BINDING MOUNTING SYSTEM

FIELD OF THE INVENTION

This invention relates to a binding mounting system for a ski apparatus. More particularly, this invention relates to a new binding mounting system for a ski apparatus, such as a snowboard, which allows releasable attachment of various different types of bindings to a snowboard.

BACKGROUND

Downhill skiing, and more recently snowboarding, are popular winter sports throughout the world. While both of the sports involve moving down a snow-covered slope under the effect of gravity, that is where the similarities end.

Skiing, including traditional and monoski styles, utilizes a fairly standard and well developed technique. The technique is basically defined by the manner in which the skis are attached to and oriented with the skier. Skis are proportionally much longer than they are wide, and as such the sport has developed with the skier being fixedly positioned generally just behind the middle of the length of the skis, and facing in a direction parallel to the skis' longitudinal axis. This placement and orientation of the skier on the skis facilitates the effective ski control techniques necessary to successfully navigate a ski-run.

In controlling and steering the skis, the skier primarily utilizes the longitudinal edges of the skis in conjunction with unified body movement (weight-shifting to the side, forwardly and rearwardly) in turning and stopping. The end result is a very highly-refined style requiring coordinated and deliberate movement between the feet, legs, hips and upper body.

The quick and precise movement necessary to negotiate most ski slopes, in combination with the elongated proportion of the ski, resulted in the development of the hard-shelled ski boot to allow effective control of the ski. Since skis are relatively long compared to the length of the skier's foot, as well as being generally the same width as the skier's foot (monoskis are generally the same width as the combination of the skier's feet) a high level of torque is necessary to move the skis in any given direction. An adequate lever-arm is also required to apply pressure to the desired edge to turn the skis. Hard-shelled ski boots provide the rigidity needed to effectively move the skis and apply force to an edge.

Ski boots are held to skis by the use of a ski boot binding system, which is attached parallel to the longitudinal axis of the ski. The bindings are typically releasably affixed directly to the ski using screws to accommodate different manufacturer mounting standards and boot lengths. Since bindings are mounted directly to the skis, any ski binding can be mounted on any ski by simply patterning and drilling the appropriate holes in the ski. Skis can only withstand a few sets of mounting holes before the holes weaken the skis and make it unsafe to ski due to the risk of pulling the bindings out of the skis. The bindings are made to release the boot if the boot moves in certain directions under a certain force. Releasable bindings reduce the risk of serious injury to a skier's knees and body as a result of an accident.

Monoskis are wider than normal skis and are tapered from tip to tail, but still have a similar elongated proportion. Monoskis are generally as long as regular skis, yet wide enough so both feet can be mounted next to each other on the ski. Monoskis are skied virtually in the same manner as regular skis except the skier does not have independent foot movement. The boots and bindings used with monoskis are identical to those used with regular skis, for the same reasons set forth above.

Snowboarding has become a popular alternative to skiing. Snowboards are longer than they are wide, but are substantially less proportionally elongated than are skis or monoskis. The technique of riding a snowboard, as described below, is much different than the technique of skiing. Since snowboards are shorter and wider than skis, they behave differently than skis in certain types of conditions.

Snowboarding utilizes a fairly standard technique. As with skis, the technique is basically defined by the manner in which the snowboarder is attached to and oriented with the snowboard. Snowboards are ridden in a manner similar to surf-boards, with the snowboarder facing generally transversely to the longitudinal axis of the snowboard. One foot is typically placed towards the front and at an angle between 45° and 90° from the longitudinal axis, while the other foot is typically placed towards the rear of the snowboard at a similar angle from the longitudinal axis.

The snowboarder controls movement by leaning to the left or the right of the direction in which the snowboard is moving to apply an edge and carve a turn. More abrupt turns can be accomplished by pushing or pulling the rear foot in the appropriate direction. The snowboarder also utilizes the longitudinal edges of the snowboard, as does a skier, but the movement is much more fluid and less mechanical than the technique used by a skier. The end result is a stable, efficient, and fluid technique requiring balance and coordinated movement.

The width of the snowboard allows the foot to be mounted transverse to the longitudinal axis, unlike skis where the width mandates that the bindings (and thus the skier) be oriented along the ski's longitudinal axis. This placement and orientation of the snowboarder on the snowboard facilitates the effective control techniques necessary to successfully navigate a ski-run. The width of the snowboard, and the orientation of the snowboarder's feet across the longitudinal axis of the snowboard, allows the appropriate level of forces to be developed necessary for applying an edge without the enhanced leveraging and torque effect of hard-shelled boots.

The soft-shell boots used with snowboards require different types of bindings than do hard-shelled boots used with skis. Because snowboarding is still a relatively young sport, the binding systems developed to date are not standardized across the industry. Unlike skiing, where the ski has only a small width of ski to use to mount the binding, thus forcing the binding styles to adhere to only a few standard options, snowboard binding manufacturers have much fewer restrictions, allowing more flexibility with binding placement on the board from side to side and more normally front to back for each foot. The bindings are generally secured to the snowboard by releasable fasteners, such as screws, mounted in apertures in the snowboard. Hard shelled snowboarding boots have recently been developed to enhance the control of the snowboard. Appropriate bindings have also been developed for use with hard-shelled snowboard boots and snowboards.

Similar to skis, it is undesirable to drill several sets of holes in a snowboard to facilitate the use of different snowboard bindings. As a result, snowboard manufacturers have developed their own different and unique binding mounting systems. These special binding mounting systems necessitate the use of a binding that requires a certain pre-placed hole pattern in a board. In this manner, the snowboard binding manufacturers require the snowboarder to purchase a specific type of binding that utilizes the hole pattern in a certain brand of snowboard.

There is missing in the art a binding mounting system that allows the application of bindings to snowboards, or skiing apparatus, such as to allow the user to be oriented along the longitudinal axis of the snowboard, without requiring specially drilled mounting holes in the snowboard, and which allows a user to "ski" on a snowboard. It is to overcome this shortcoming in the art that the present invention has been developed.

SUMMARY OF THE INVENTION

It is a primary object of the present invention to provide a binding mounting system to mount bindings on a ski apparatus.

It is another object of the present invention to provide a binding mounting system to mount ski bindings on a ski apparatus.

It is another object of the present invention to provide a binding mounting system to mount snowboard plate bindings on a ski apparatus.

It is another object of the present invention to provide a binding mounting system which allows a pair of bindings to be mounted together in a forwardly facing manner on a ski apparatus.

The invention is generally embodied in a binding mounting system for releasably mounting bindings on a ski apparatus. The ski apparatus has a front end, a rear end, a top surface, and front and rear mounting locations adjacent to the front end and rear end, respectively. The binding mounting system comprises a binding plate having a front end and rear end, a first mounting structure positioned adjacent to the front end of the binding plate, a second mounting structure positioned adjacent to the rear end of the binding plate, the binding plate being positioned on a top surface of the ski apparatus.

The first mounting structure is positioned coextensive with the front mounting location of the ski apparatus, and the second mounting structure is positioned coextensive with the rear mounting location of the ski apparatus. The first mounting structure is releasably attachable at the front mounting location, and the second mounting structure is releasably attachable at the rear mounting location.

The first and second mounting structures comprise a patterned plurality of apertures formed through said binding plate, a slot pattern formed through said binding plate, or a single slot formed through said binding plate for receiving a cassette, the cassette mounting to the binding plate through the slot.

The binding mounting system may also include a riser for spacing the binding plate away from the ski apparatus, a conversion plate for mounting between the ski apparatus and either the riser or binding plate to allow use of the binding system with non-standard mounting techniques, and binding adapter plates to use with non-standard mounting patterns on bindings.

The front and rear ends of the binding mounting plate for use with ski bindings have a relatively large lateral dimension, while the main body between the front and rear ends has a reduced lateral dimension. The front and rear ends of the binding mounting plate for use with snowboard plate bindings have a relatively narrow lateral dimension, while the main body between the front and rear ends has an increased lateral dimension.

The use of the binding mounting system allows the user to mount bindings on a ski apparatus without having to redrill adequate binding mounting apertures in the ski apparatus. In this manner, the binding mounting system can be moved from ski apparatus to ski apparatus easily.

Other aspects, features and details of the present invention can be more completely understood by reference to the following detailed description of a preferred embodiment, taken in conjunction with the drawings and from the appended claims.

DETAILED DESCRIPTION OF THE PREFERRED EMBODIMENT

Figure 1:
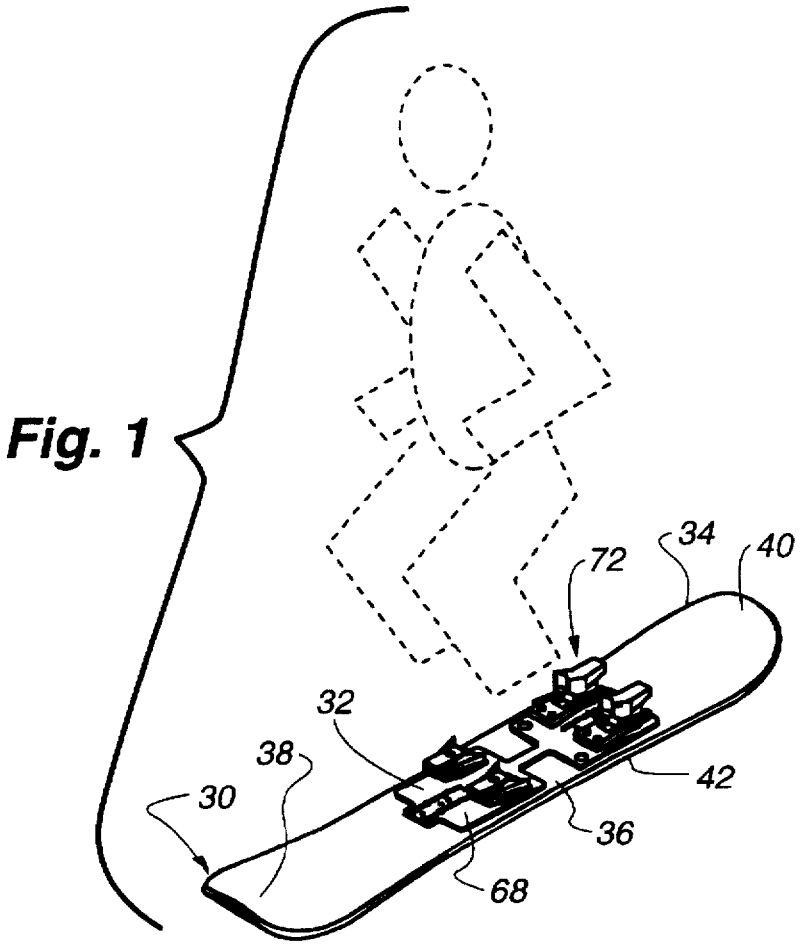
FIG. 1 is a perspective view of a ski apparatus, particularly a snowboard, having the binding mounting system of the present invention attached thereto, and of a figure positioned in a forwardly facing direction with respect to the snowboard.

The examples provided herein pertain to the use of the present invention on a snowboard type ski apparatus 30, as shown in FIG. 1, however it is fully contemplated that the binding mounting system 32 of the present invention can be used on any ski apparatus where both feet are positioned on the same ski apparatus.

For the purposes of the present disclosure, snowboard bindings are categorized as bindings that is typically used on a snowboard, and which utilizes the patterned apertures found in the snowboard; plate bindings are categorized as racing bindings used with hard-shelled snowboard boots; and ski bindings are categorized as bindings normally used with hard-shelled ski boots and skis.

Figure 2:
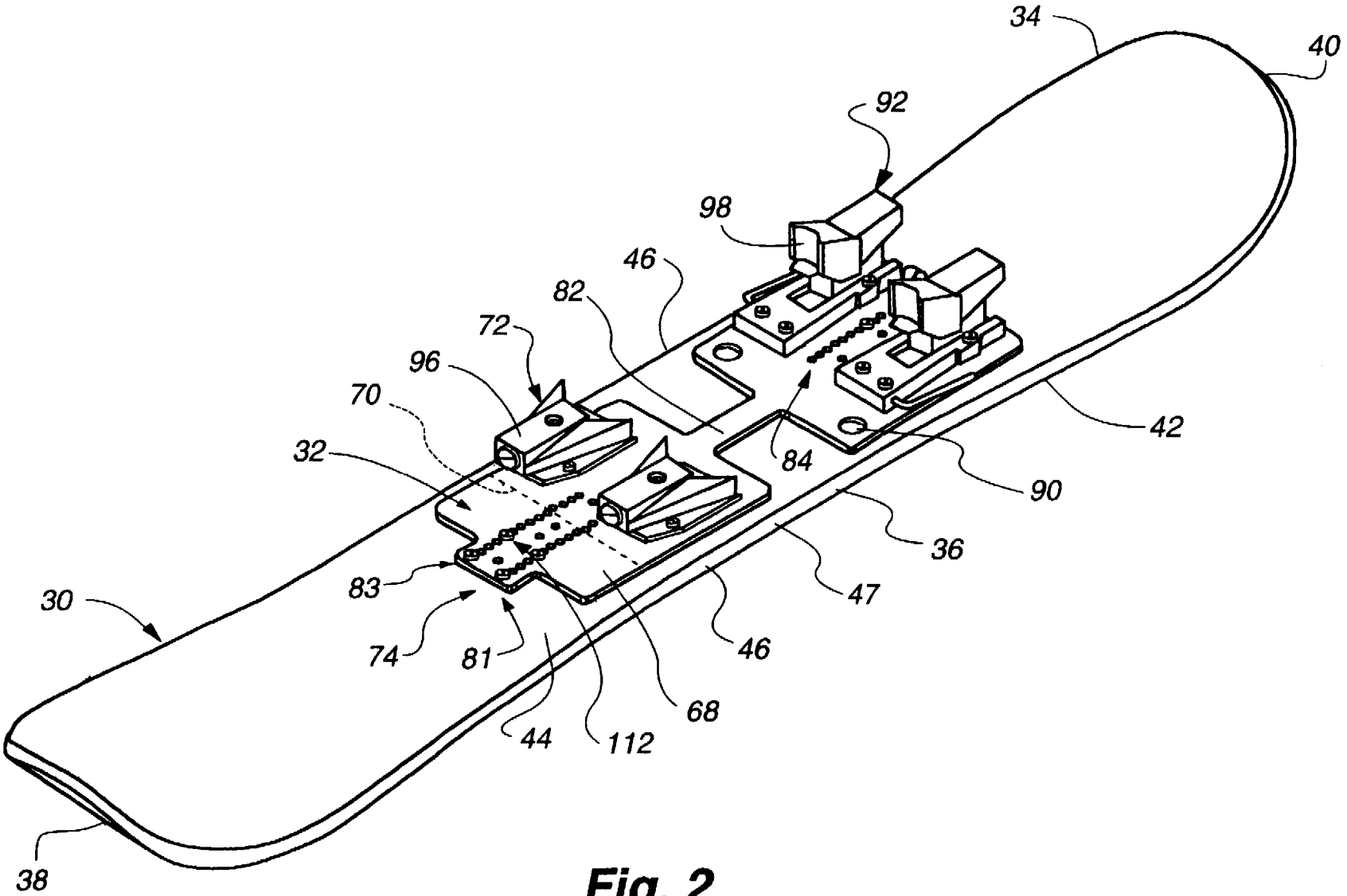
FIG. 2 is an enlarged perspective view of a snowboard having the binding mounting system as shown in FIG. 1, illustrating a binding plate used to mount ski bindings to the snowboard.

As seen in FIGS. 1 and 2, snowboards 34 typically have a relatively flat elongated body 36 with upwardly curving front 38 and rear 40 opposing ends. A bottom surface 42 of the snowboard is prepared for gliding on snow-covered surfaces, while the top surface 44 of the snowboard 34 is prepared for attaching snowboard bindings (not shown). The opposing longitudinal side edges 46 of the snowboard 34 typically define a large side cut, resulting in the snowboard having a greater width at its ends 38 and 40, and converging to a narrowest width at a location 47 intermediate the front 38 and rear 40 ends.

A snowboard 34 has camber or arch along its length, which causes the bottom surface 42 to have a concave curvature, and the top surface 44 to have a corresponding convex curvature. Most snowboards 34 have a traction pad 48 (see FIGS. 7 and 14) for use in controlling the snowboard with the user's foot when the user is released from the snowboard bindings. The traction pad 48 has a certain thickness and is mounted to the top surface 44 of the snowboard 34.

Figure 3:
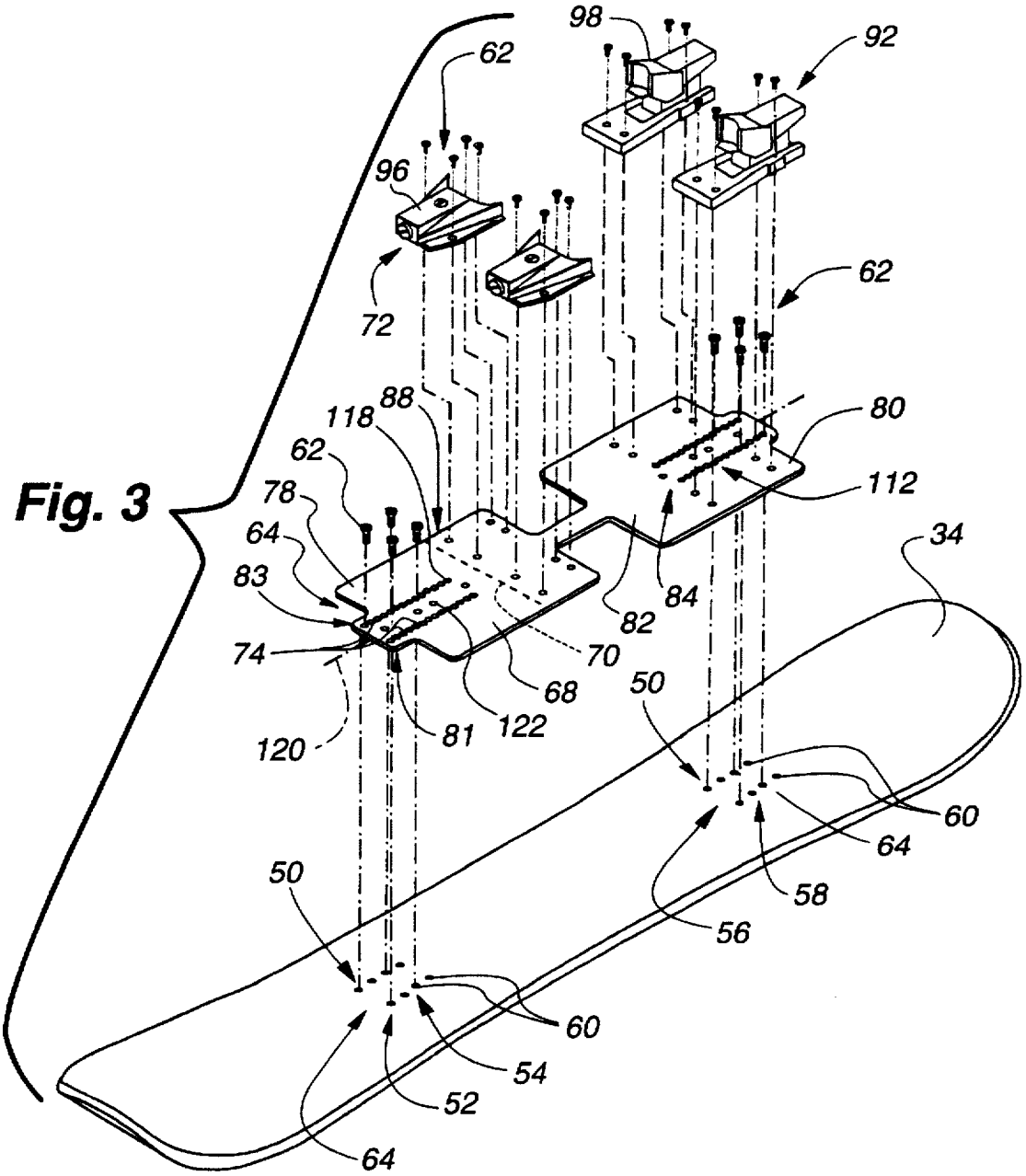
FIG. 3 is an exploded view of the binding mounting system as shown in FIG. 1.

Snowboard bindings (not shown) are typically attached directly to the top surface 44 of the snowboard 34, and are spaced in a longitudinal orientation at the position of binding mounting apertures 50, as seen in FIG. 3. There is one snowboard binding for each of the user's feet. A first group 52 of binding mounting apertures 50 are generally positioned towards the front end 38 of the snowboard 34, defining a front mounting location 54, and a second group 56 of binding mounting apertures 50 are positioned toward the rear end 40 of the snowboard 34, defining a rear mounting location 58. Each group of binding mounting apertures 52, 56 typically consist of a pattern of threaded apertures 60 formed in the snowboard 34. The threaded apertures 60 are designed to work in conjunction with and receive threaded fasteners 62, such as screws, which are used to attach the snowboard bindings directly to the appropriate mounting apertures 50. The threaded fasteners 62 are releasably engageable with the threaded apertures 60 to allow for mounting and dismounting snowboard bindings.

Figure 4:
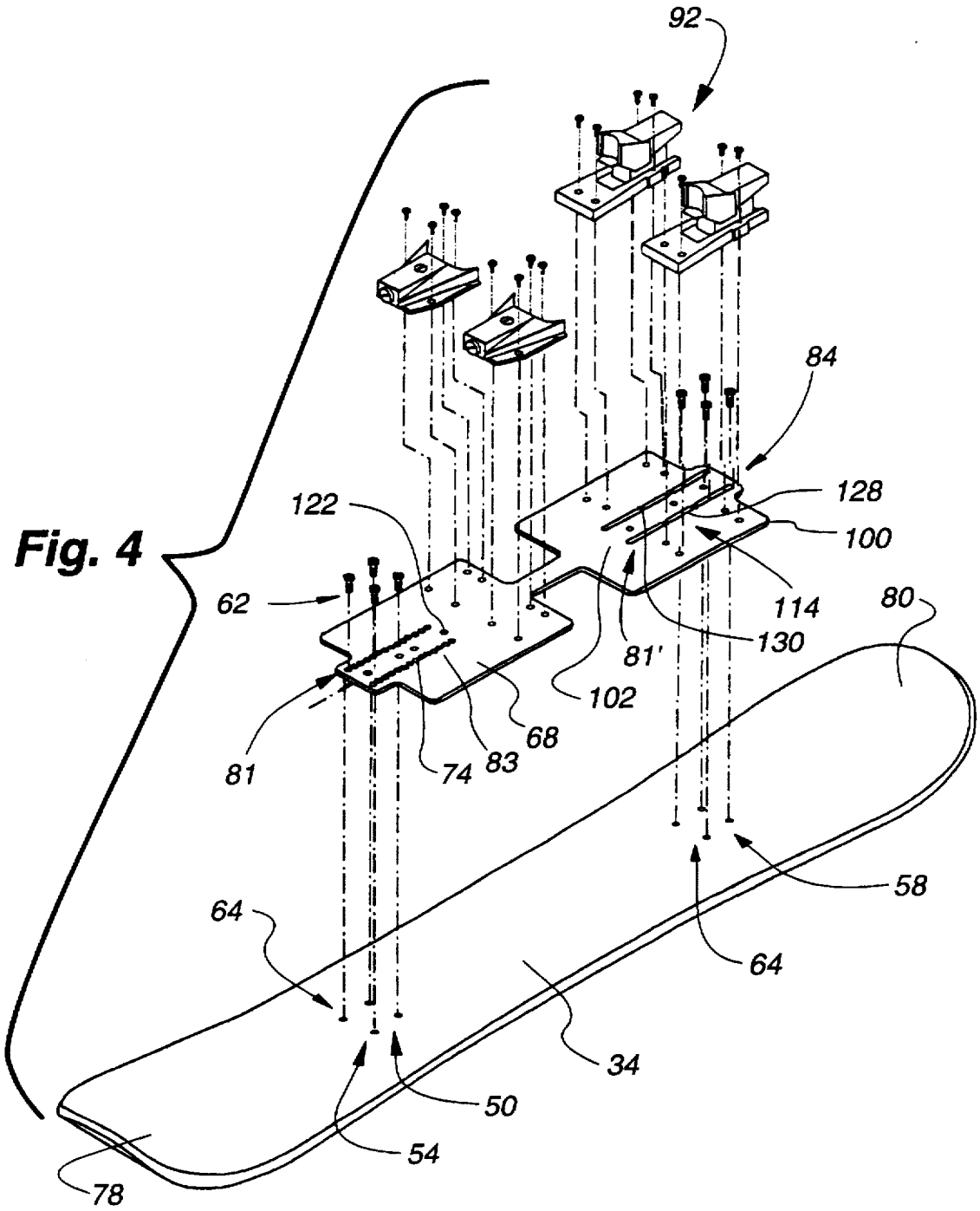
FIG. 4 is an exploded view of an alternative embodiment of the snowboard binding mounting system as shown in FIG. 3, illustrating a mounting structure utilizing slots.

There are several manufacturers of snowboards, many with different mounting aperture patterns. The different mounting aperture patterns 50 can be used only with certain snowboard bindings designed for use with that particular pattern of mounting apertures 50. A standard mounting aperture pattern 64 is a square having sides of 4 centimeters in length (see FIGS. 4 and 9), and the apertures positioned at the corners of the square, as seen in FIGS. 3 and 4. Several sets of 4 centimeter square mounting apertures are aligned longitudinally in the front mounting location 54 of the snowboard 34 to allow the user to mount the front snowboard binding in any of a plurality of longitudinally spaced positions as desired, and as seen in FIG. 3. Similarly, the same pattern of mounting apertures 50 is positioned at the rear mounting location 58 to allow for a corresponding plurality of mounting positions for the rear snowboard binding.

Figure 5:
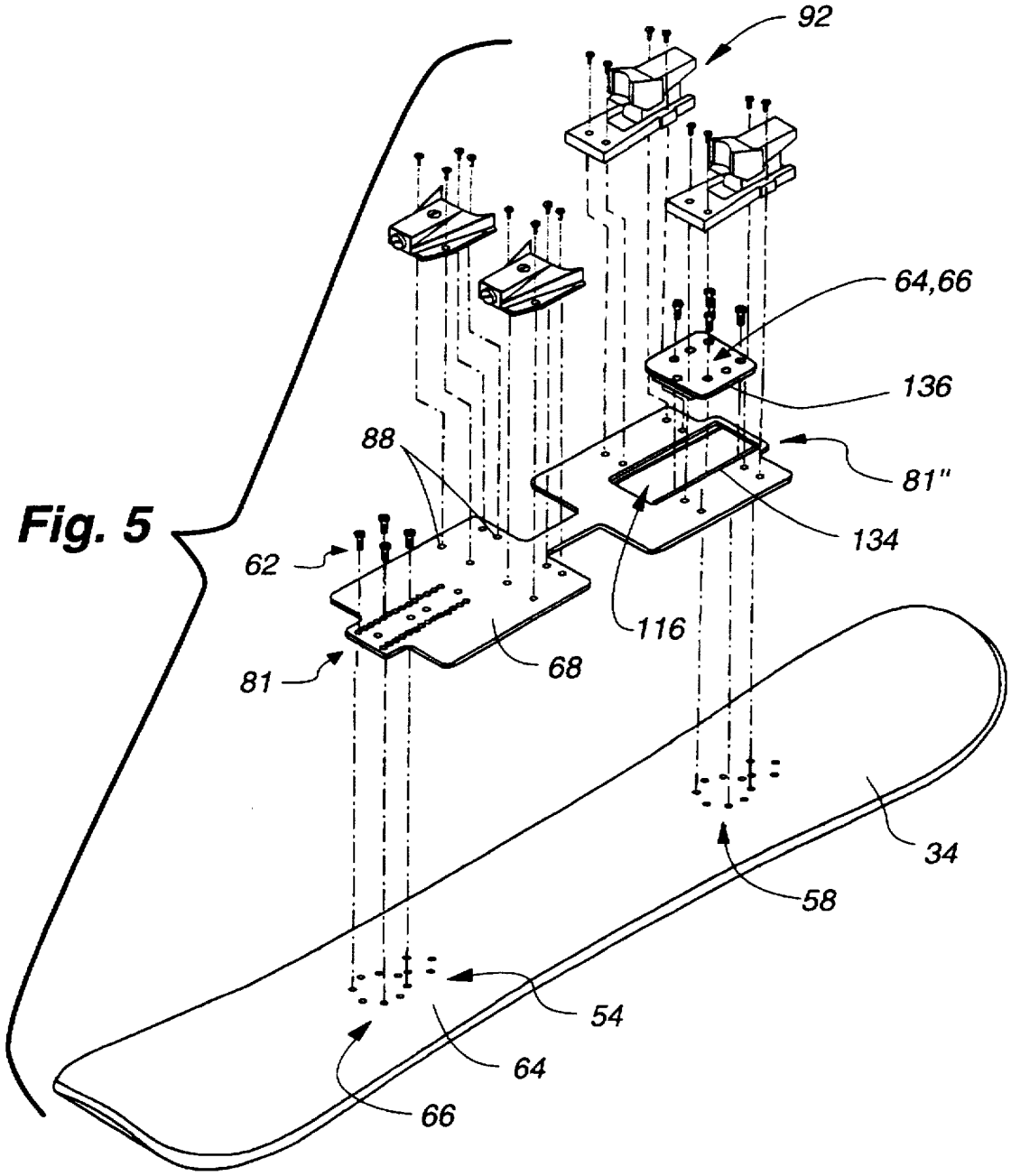
FIG. 5 is an exploded view of an alternative embodiment of the snowboard binding mounting system as shown in FIG. 3, illustrating a mounting structure utilizing a slot and a cassette.
Figure 7:
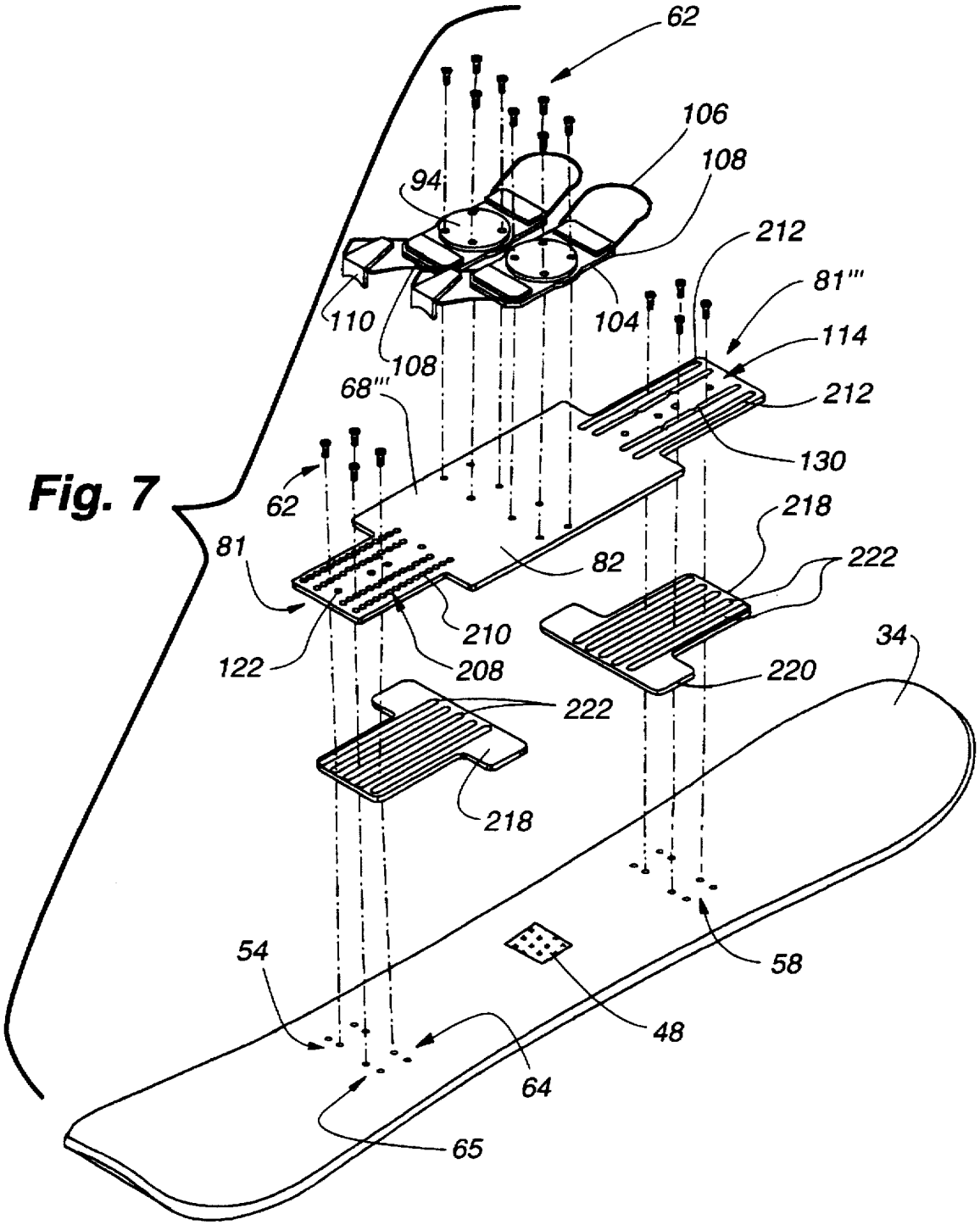
FIG. 7 is an exploded view of the embodiment of the present invention as disclosed in FIG. 6.
Figure 8:
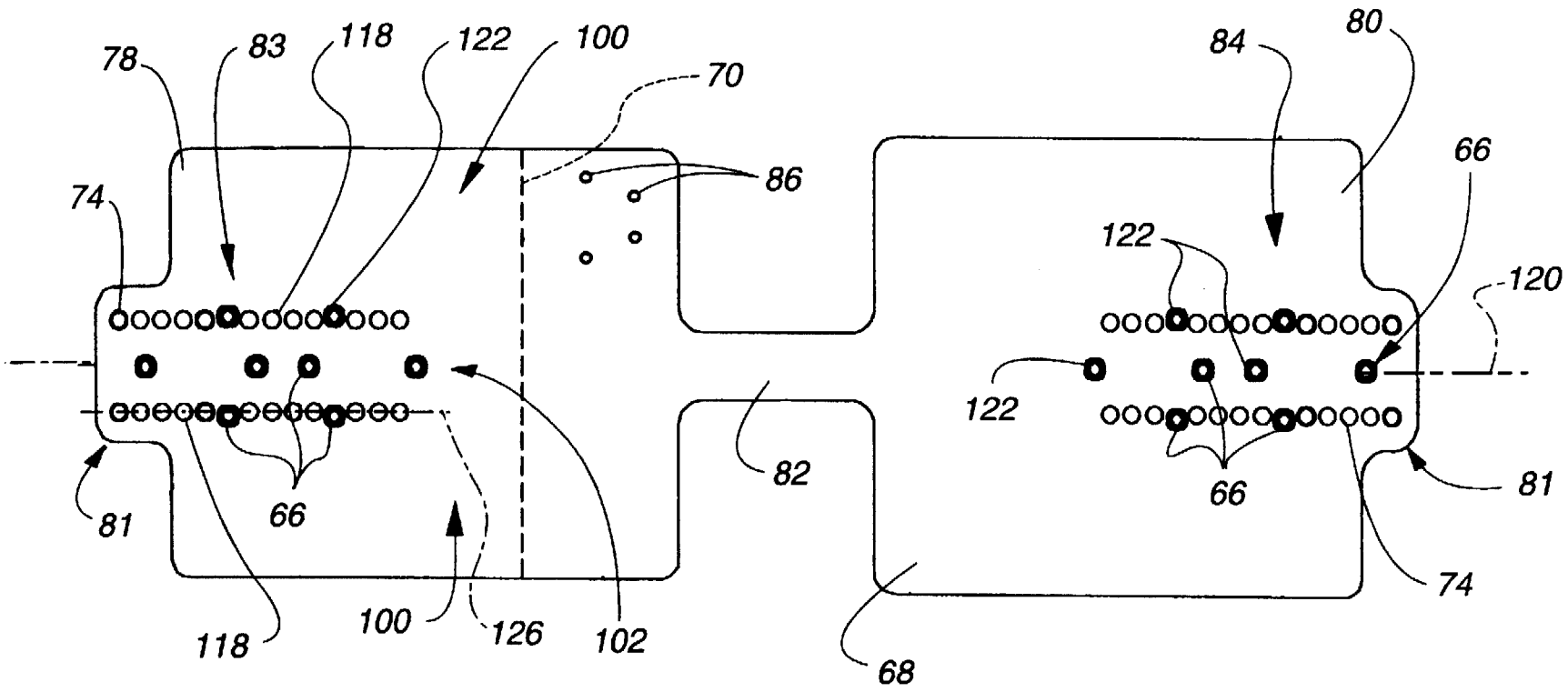
FIG. 8 is a plan view of an embodiment of the binding mounting plate for use with ski bindings.
Figure 9:
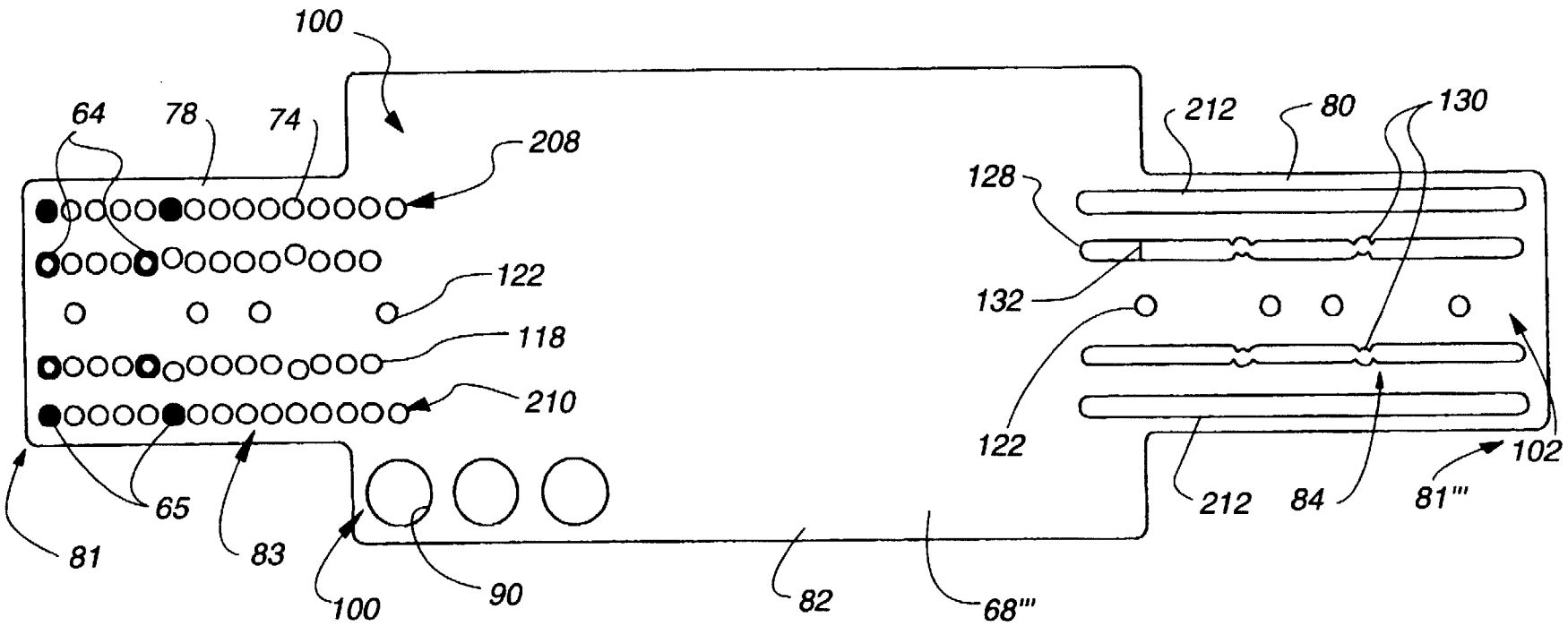
FIG. 9 is a plan view of an embodiment of the binding mounting plate for use with snowboard plate bindings.

Another snowboard manufacturer uses a mounting aperture pattern 50 formed of a 5 centimeter by 8 centimeter rectangle 65 with the apertures positioned at the corners, as shown in FIGS. 7 and 9. These are also positioned at front 54 and rear mounting 58 locations. A third example of a mounting aperture pattern 50 is a triangular mounting aperture pattern 66, as shown in FIGS. 5 and 8. The triangular aperture pattern 66 allows several different mounting positions at both the front 54 and rear 58 mounting locations.

Given the variety of mounting aperture patterns 50 provided in commercially available snowboards, it is clear that many snowboards 34 require the use of a particular type of snowboard binding to avoid having to drill additional mounting apertures. There are various other mounting aperture patterns 50 unique to certain snowboard manufacturers which further increase the non-uniformity of the mounting aperture patterns 50 found on snowboards 34.

In an effort to allow the use of a particular binding on a variety of snowboards 34, the binding mounting system 32 of the present invention has been developed. In its simplest form, as shown in FIGS. 1 and 2, the binding mounting system 32 comprises a flat elongated binding plate 68 having a width 70 sufficient to mount bindings 72 together, and also includes a plurality of mounting apertures 74 which match in combination the various mounting aperture patterns 50 of commercially available snowboards 34 to which the plate 68 is to be attached. Releasable fasteners 62, such as threaded screws, are inserted through the binding plate 68 and into the mounting apertures 50 on the snowboard 34 to releasably secure it thereto. The desired bindings 72 are mounted to the binding plate 68 in the position desired by the user.

As shown in FIGS. 1–6, the binding plate 68 of the binding mounting system 32 comprises a flat plate-like structure defining a front end 78 and a rear end 80, and a main body portion 82 integrally positioned therebetween. The plurality of apertures 74 at the front end 78 and rear end 80 each form a mounting structure 81. The binding plate 68 has a first mounting structure 83 adjacent to its front end 78, and a second mounting structure 84 adjacent to its rear end 80, each corresponding to the front 54 and rear 58 binding mounting locations found on snowboards 34. Releasable fasteners 62 are used to attach the binding plate 68 to the snowboard 34 at the first 83 and second 84 mounting structures. Several different types of binding plate mounting structures 81 are described hereinafter. The bindings 72 are releasably mounted to the binding plate 68 by fasteners 62, such as screws, secured into correspondingly threaded apertures 88 in the binding plate 68.

The binding plate 68 is made of a material, or a combination of materials, such as metal, plastic, or even wood, which have a sufficient strength to maintain structural integrity in light of the various mounting structures 83, 84 formed in the plate, as well as the necessary resistance to snow, water, ice, and other weather related factors to which the binding plate 68 is exposed during use. The binding plate 68 must be strong enough to allow the formation of threaded apertures 88 for attaching the ski bindings 72 to the binding plate 68 without stripping the threaded apertures, and also must be able to withstand the torsional and sheer stresses generated by the user when skiing on the snowboard 34 using the binding mounting system 32.

The length of the binding plate 68 is sufficient to extend to and beyond the front 54 and rear 58 binding mounting locations on the snowboard 34 so that the front end 78 of the binding plate 68 can be attached to the front binding mounting location 54 on the snowboard 34, and correspondingly the rear end 80 of the binding plate 68 can be attached to the rear binding mounting location 58 on the snowboard 34, as can be seen in FIG. 3.

As an example, in a binding plate 68 made of aluminum, the binding plate could have a thickness of approximately ¼ inch to facilitate both the mounting structures 81 for use in attaching the binding plate 68 to the snowboard 34, and also for having threaded apertures 88 of adequate strength to which the bindings 72 are attached.

To facilitate reducing the weight of the binding plate 68, without compromising its structural integrity, certain portions of the binding plate 68 can be eliminated. For instance, as shown in FIGS. 2 and 9, dummy apertures 90 can be formed through the plate at positions designed to not interfere with the binding plate 68 mounting structure 81 used in attaching the binding plate 68 to the snowboard 34, or the apertures 88 used in attaching the bindings 72 to the binding plate 68. Further, as an example, the main body portion 82 can be reduced in width between the front 78 and rear 80 ends of the binding plate 68.

There are generally two types of binding plates 68, each of which is used with a different type of binding 72. The first type of binding plate 68, shown in FIGS. 1–6 and 8, is for use with ski bindings 92, while the second type of binding plate 68, as shown in FIGS. 7 and 9, is for use with snowboard plate bindings 94. The difference between the two binding plates 68 is driven by the manner in which the bindings are mounted on the binding plate 68.

Ski bindings 92 typically comprise separate toe 96 and heel 98 portions, and are attached to the first type of binding plate 68 by mounting the toe portion 96 of the ski binding 92 at a location adjacent to the front end 78 of the binding plate 68, and mounting the heel portion 98 of the ski binding 92 at a location adjacent to the rear end 80 of the binding plate 68. Two each of the toe portion and the heel portion of the ski binding are mounted at each end of the binding plate 68.

Both the front 78 and rear 80 end of the binding plate 68 are generally divided into three portions across the width 70 of the first type of binding plate 68, as seen in FIG. 8. The outer two portions 100, which bound the middle portion 102, are designed to receive the corresponding toe 96 or heel 98 portions of the ski binding 92. Threaded apertures 88, as are well known, are formed in these outer portions 100 for releasably receiving correspondingly threaded fasteners 62 used to mount the toe 96 and heel 98 portions of the ski bindings 92. The aperture pattern used for attaching the ski bindings 92 to the binding plate 68 depend on the patterns used by the ski binding manufacturer. These aperture patterns are fairly standard and can be predrilled into the binding plate. However, custom ski binding mounting aperture patterns can be provided in the appropriate outer portions 100 of the binding plate 68 as required.

The mounting structures 81 are located in the middle portions 102 of both the front 78 and rear 80 ends of the binding plate 68 for use in securing the binding plate 68 to the snowboard 34, as will be further described below.

A ski-boot (not shown) is rigid, and when positioned in the ski binding 92, it spans the main body portion 82 of the binding plate 68. Since the main body portion 82 of the binding plate 68 is not used for mounting the ski binding 92, it can be eliminated to some extent to reduce the mass of the binding plate 68. As such, the binding plate 68 used for ski bindings 92 has full-width front 78 and rear 80 ends, with a reduced-width main body portion 82. A continuous part of the main body portion 82 preferably extends between the front 78 and rear 80 ends of the binding plate 68 to maintain rigidity and structural integrity.

Figure 6:
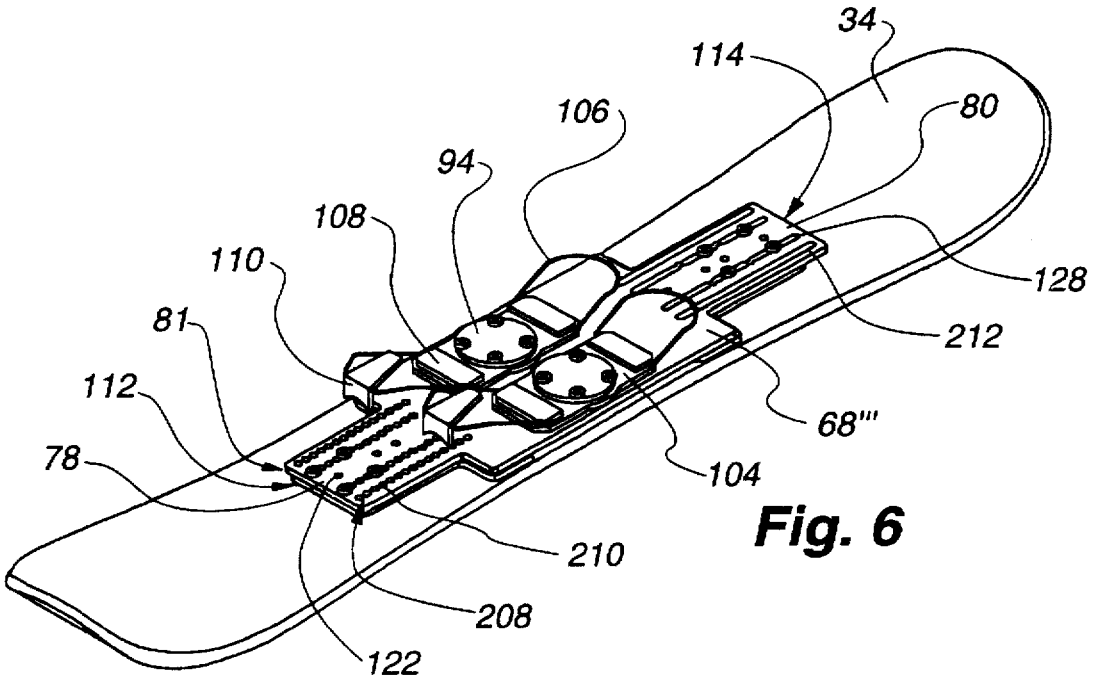
FIG. 6 is a perspective view of an alternative embodiment of the binding mounting system of the present invention, illustrating a binding plate for use with snowboard plate bindings.

The second type of binding plate 68 is used with snowboard plate bindings 94, and are shown in FIGS. 6 and 7. The plate bindings 94 are used with hard-shelled snowboarding boots (not shown), and comprise a base portion 104 having one wire bale 106 extending from each end 108 of the base portion 104. One of the bales 106, corresponding to the front of the snowboarding boot, has an over-center latch 110 which clips the toe of the boot into the binding securely. Plate bindings 94 are attached to the second type of binding plate 68 by mounting the base portion 104 of the plate binding 94 adjacent to the main body 82 of the binding plate 68, intermediate to the front 78 and rear 80 ends of the binding plate 68.

The plate bindings 94 do not form a boundary to the binding plate mounting structure 81, and thus the mounting structure 81 on the second type of binding plate 68 is compatible with more types of binding mounting aperture patterns 50 found on snowboards 34. Also, the outer portions 100 of the binding plate 68, at both the front 78 and rear 80 ends can be removed to reduce the mass of the binding plate 68. The resulting shape of the second type of binding plate 68 defines a full width main body portion 82 with reduced width front 78 and rear 80 ends.

The binding plate mounting structure 81 used on the two types of binding plates 68 has several different embodiments. The binding plate mounting structure 83, 84 is positioned, as described above, adjacent to the front 78 and rear 80 ends of the binding plate 68. The mounting structure 81 positioned at each end of the binding plate 68 generally comprises a plurality of patterned apertures 112 (see FIG. 3), a combination of longitudinal slots and apertures 114 (see FIG. 4), or a slot and cassette clamping structure 116 (see FIG. 5), each of which is described in detail below. It is contemplated that each of the described mounting structures 81 can be mixed and matched on any style of binding plate 68 as desired by the user.

In the following description of the different types of mounting structures, the mounting structure 83 placed at the front end 78 of the binding plate 68 is consistently the plurality of patterned apertures 112, while the mounting structure at the rear end is changed to facilitate the description of the different types of mounting structures 83. However, it is contemplated that the various mounting structures described can also be used on the front end 78 of the binding plate 68.

In the first preferred embodiment, as best seen in FIGS. 3 and 8, the first mounting structure 83 on the binding plate 68 comprises an aperture pattern 112 of two rows 118 of apertures 74 spaced 4 centimeters apart on center. The apertures in each row 118 are juxtaposed with, or are positioned next to, one another, and the rows 118 are positioned on opposite sides of and are equidistant from the longitudinal axis 120 of the binding plate 68 in a line parallel thereto. The row 118 of apertures allows the user to adjust the position of the binding plate 68 forwardly or rearwardly relative to the snowboard 34 at increments at least equal to the spacing between adjacent apertures, or approximately 1 centimeter as measured center to center if the apertures are circular.

Interspersed in each of the rows 118 of apertures 74, and equidistant between the rows 118 of apertures 74, are apertures 122 necessary for fitting the triangle mounting aperture pattern 66. Some of these specially placed apertures 122 are spaced just outwardly of the rows 118, and they act in conjunction with the apertures 122 between the rows. The apertures 74 have a maximum dimension, and the offset apertures 122 are spaced outwardly from the rows 118 preferably by not more than the maximum dimension. The apertures 122 are indicated by the heavy-outlined circles in FIG. 8. The offset apertures 122, for instance if circular in shape, have a center positioned 0.15 centimeters outwardly from the longitudinal line 126 running through the row 118 of apertures 74.

The mounting structure 84 at the rear end 80 of the binding plate 68 can replicate the mounting structure 83 at the front 78 of the binding plate 68. In this first embodiment it is important to know the exact distance between the front 54 and rear 58 binding mounting locations on the snowboard 34 in order to ensure that the mounting structures 81 on the binding plate 68 correspond to the binding mounting locations 54, 58 on the snowboard.

In a second embodiment, shown in FIGS. 4 and 9, the mounting structure 81' comprises a pattern of elongated slots 128 in the second mounting structure 84 of the binding plate 68. The slots 128 are positioned on the binding plate 68 identically to the aperture rows 118 of the first embodiment. Use of slots 128 eliminates the problem of the variable distance between the front and rear binding mounting locations 54, 58 on the snowboard 34, since the slots 128 allow infinite adjustment from one end to the other as required by the specific distance between the front 54 and rear 58 binding mounting locations on the snowboard 34. The necessary inner apertures 122 for the triangular aperture pattern 66 are located between the slots as best seen in FIG. 9. Portions 130 of each slot 128, at select positions, extend outwardly from the laterally spaced slots 128 not more than one transverse dimension 132 of the slot 128 in replacement of the outer apertures of the first embodiment.

A third embodiment of the mounting structure 81" for use on the rear end 80 of the binding plate 68 includes the use of a wide slot 134 and a corresponding cassette 136, as shown in FIGS. 5, 10–13 and 18. Generally, the cassette 136 is positioned in the slot 134 and is releasably attached to the snowboard 34, thereby clamping the binding plate 68 to the snowboard 34. The cassette 136 has the appropriate mounting structure 81 formed therein, including the 4 by 4 centimeter pattern and the triangular aperture pattern 66. Only one complete set of each needs to be formed in the cassette 136 since the cassette 136 can move forwardly and rearwardly in the slot 134. The cassette 136 can be positioned over the appropriate and desired binding mounting location 54, 58 formed in the snowboard 34 by moving it along the slot 134. The releasable fasteners 62 are positioned through the mounting apertures in the cassette 136, and are releasably threaded into the apertures 50 in the snowboard 34 to secure the cassette 136 at that location.

The slot 134 is formed through the binding plate 68 and has an elongated shape defining opposing laterally spaced longitudinal edges 138 and opposing front and rear edges 140, and also defines a longitudinal axis 142. The slot 134 has a length dimension 144 and width dimension 146. The length dimension 144 is parallel to the longitudinal axis 142, and the width dimension 146 is transverse to the longitudinal axis. The longitudinal axis 142 of the slot 134 is positioned along the longitudinal axis of the binding plate 68, and the slot 134 extends an equal distance to either side of the longitudinal axis of the binding plate 68. The slot 134 has a width dimension sufficiently great to encompass the apertures 50 in the front 54 and rear 58 binding mounting locations.

A rail 148 (FIG. 11) extends inwardly toward and is continuous along each longitudinal edge 138 of the slot 134. The rail 148 is rigid and extends from a bottom section 150 of the longitudinal edge 138, and defines an upwardly facing contact surface 152 offset below the upper surface 151 of the binding plate 68, and a lower surface 154 flush with the lower surface 153 of the binding plate 68.

The cassette 136 has a main body portion 156 having an upper 158 and lower 160 surface, and defines laterally opposing side edges 162 and opposing front and rear edges 164. The main body 156 of the cassette 136 has a length dimension less than the length dimension of the slot 134, a width dimension substantially equal to but just less than the width dimension of the slot 134, and a thickness dimension substantially equal to the thickness of the binding plate 68. The cassette 136 has a mounting structure 81 formed therein. Preferably, the cassette 136 has a pattern 64 of four apertures located at the corners of a 4×4 centimeter square, as defined above. The apertures necessary for the triangular mounting aperture pattern 66 are also formed in the cassette.

A flange 166 extends outwardly from and is continuous along each laterally opposing edge 162 of the cassette. The flange is rigid and extends from a top section 168 of the laterally opposing edge 162, and defines an upper surface 170 flush with the upper surface 158 of the cassette 136, and a downwardly facing contact surface 172 offset above the lower surface 160 of the cassette 136.

Figure 18:
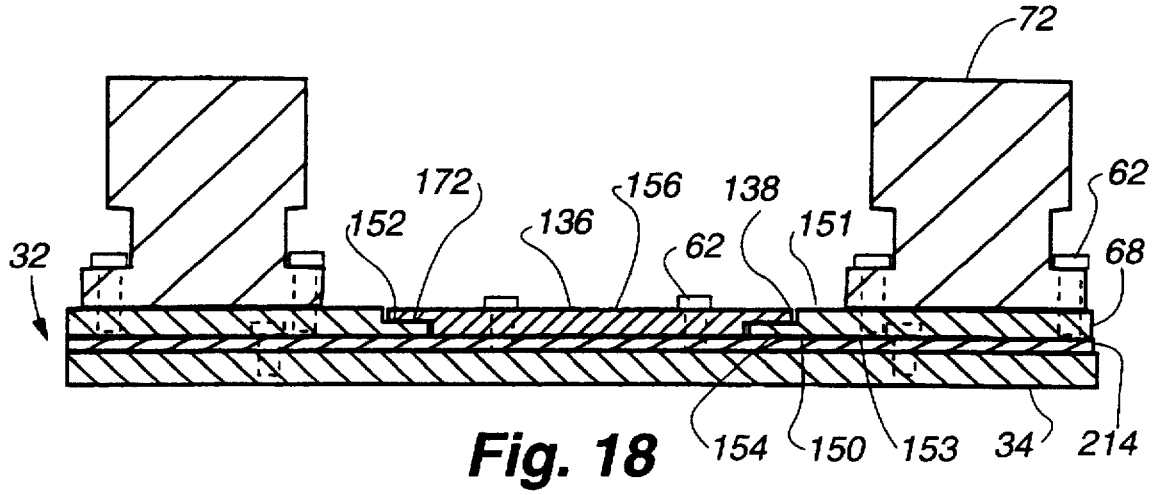
FIG. 18 is a representational section view of the binding mounting system, illustrating a snowboard, conversion plate, mounting plate with cassette, and ski bindings.

The cassette 136 acts to attach the binding plate 68 to the snowboard 34 by clamping the binding plate 68 against the top surface 44 of the snowboard (FIG. 18). The slot 134 is designed to be positioned on the binding plate 68 so as to expose the binding mounting aperture pattern 50 on the snowboard 34. The cassette 136 is positioned in the slot 134 such that the desired mounting structure 81 formed in the cassette 136 is oriented properly over the apertures of the binding mounting location 54 or 58 on the snowboard 34, and releasable fasteners 62 are positioned through the mounting structure 81 to releasably engage the apertures 50 of the binding mounting location 54 or 58. When the fasteners 62 attach the cassette 136 to the snowboard 34, the downwardly facing contact surface 172 of the flanges 166 engage the upwardly facing contact surface 152 of the rails 148 and act to clamp or fixedly secure the binding plate 68 to the snowboard 34, as best seen in FIG. 18. The thickness dimensions of the flanges 166 and rails 148 are designed to insure that when the cassette 136 is attached to the snowboard 34, a sufficient amount of interfering engagement between the flanges 166 and the rails 148 is generated to fix the binding plate 68 in position. The cassette 136 and slot 134 system of the third embodiment offer extensive adjustability for both the standard 4×4 centimeter binding mounting pattern and the triangular pattern 66.

Figure 10:
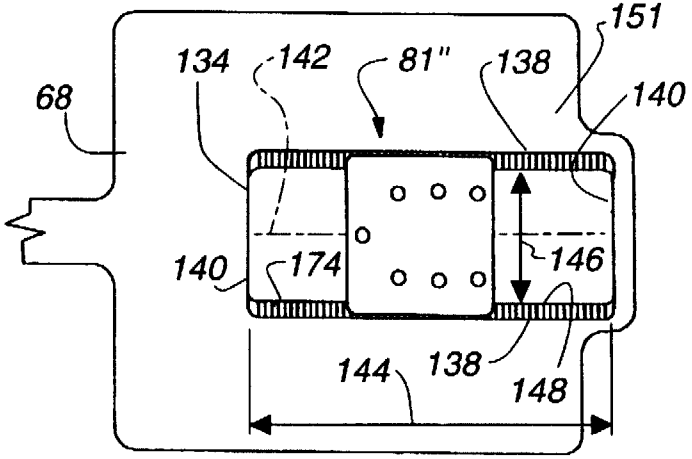
FIG. 10 is a partial plan view of the binding mounting plate illustrating the slot and cassette.
Figure 12:
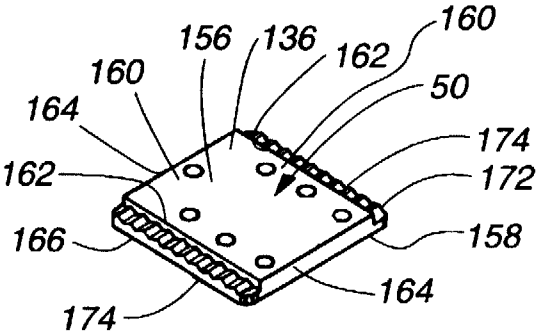
FIG. 12 is a bottom perspective view of the cassette as shown in FIG. 11.
Figure 11:
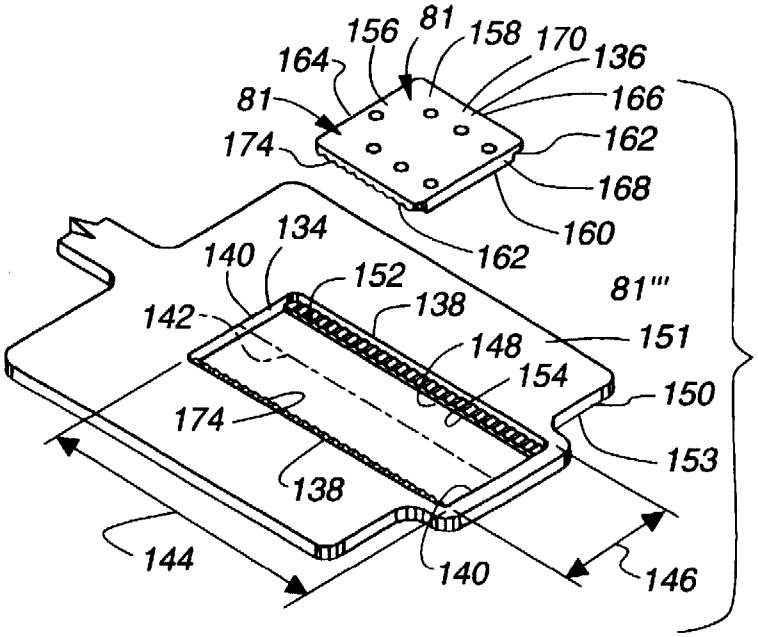
FIG. 11 is a partial exploded view of the binding plate as shown in FIG. 10.
Figure 13:
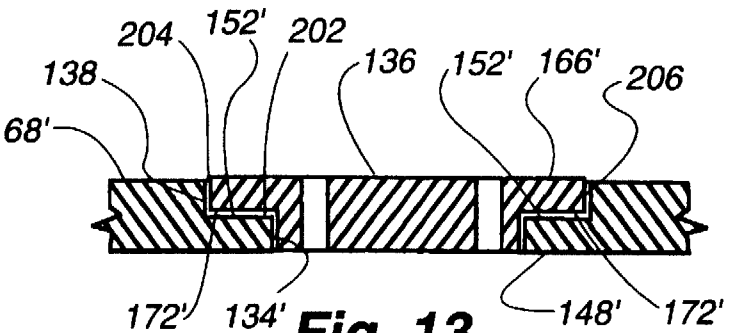
FIG. 13 is a representational section view through the slot and cassette illustrating gaps formed therebetween.

The upwardly facing contact surfaces 152 of the rails 148, and the downwardly facing contact surfaces 172 of the flanges 166, can be substantially smooth, have a frictional surface treatment, or be serrated. (See FIGS. 10–13) The serrations 174 as shown in FIGS. 10–12 are formed on the upwardly facing contact surface 152 and the downwardly facing contact surface 172. The serrations 174 mate with each other when the cassette 136 is placed in the binding plate 68 with respect to the cassette and snowboard 34. While the cassette 136 may work in compression to clamp the binding plate 68 to the snowboard 34 as described above, a frictional or serrated surface would assist in minimizing any forwardly or rearwardly directed slippage of the binding plate 68 relative to the cassette 136 and the snowboard 34.

In another embodiment (FIG. 13), the cassette 136' is mounted to the snowboard 34 inside the slot 134' and allows the binding plate 68' to "float," or move forwardly and rearwardly as is necessary to adjust to the flex of the snowboard 34. The cassette 136' maintains the lateral position of the binding plate 68' on the snowboard 34. The cassette 136' and slot 134' are designed to allow the binding plate 68' to float by adjusting the thickness dimension of the flange 166' and/or the rail 148'.

For instance, the binding plate 68' has a thickness dimension X, and the flange 166' and rail 148' have thickness dimensions Y and Z, respectively. If dimensions Y and Z are chosen so that when the cassette 136' is positioned in the slot 134' and adjacent to the top surface 44 of the snowboard 34, the upwardly facing contact surfaces 152' of the rails 148' do not engage the downwardly facing contact surfaces 172' of the flanges 166'. A gap 202 is thus formed therebetween, allowing the binding plate 68' to move forwardly and rearwardly as is necessary with respect to the cassette 136'. Also, the corresponding outwardly 204 and inwardly 206 facing edges of the cassette 136' and slot 134', respectively, can be designed not to engage one another, allowing a slight amount of lateral movement of the binding plate 68' with respect to the snowboard 34.

A fourth embodiment of the binding mounting structure 81'" is used in conjunction with the second type of binding plate, and is best disclosed in FIGS. 7 and 9. The binding plate 68'" in this fourth embodiment is similar to the binding plate 68 in the first embodiment, however the front 78 and rear 80 ends of the binding plate 68'" define only the middle 102 of the three portions as found in the first embodiment of the binding plate 68. This fourth embodiment of the binding mounting structure 81'" is for use with plate bindings 94.

The mounting structure 81'" utilized on this fourth embodiment of the binding plate 68'" is similar to the mounting structure 81' in the second embodiment as previously described, having rows 118 of apertures 74 at the front end 78 and elongated slots 128 at the rear end 80. This fourth embodiment, however, has an outer row 208 of apertures 210 on either side of the mounting structure 83 at the front end 78, and an outer slot 212 on either side of the mounting structure 84 at the rear end 80. The additional apertures 210 and slots 212 correspond to the 5 centimeter by 8 centimeter binding mounting aperture pattern 65. The fourth embodiment comprises a mounting structure capable of mounting on 4×4 centimeter binding mounting aperture pattern 64, 5×8 centimeter binding mounting aperture pattern 65, and the triangular binding mounting aperture pattern 66. This fourth mounting structure embodiment is not easily used with ski bindings 92 because the 5×8 centimeter binding mounting aperture pattern interferes with the attachment of the ski bindings 92 to the binding plate 68.

Figure 14:
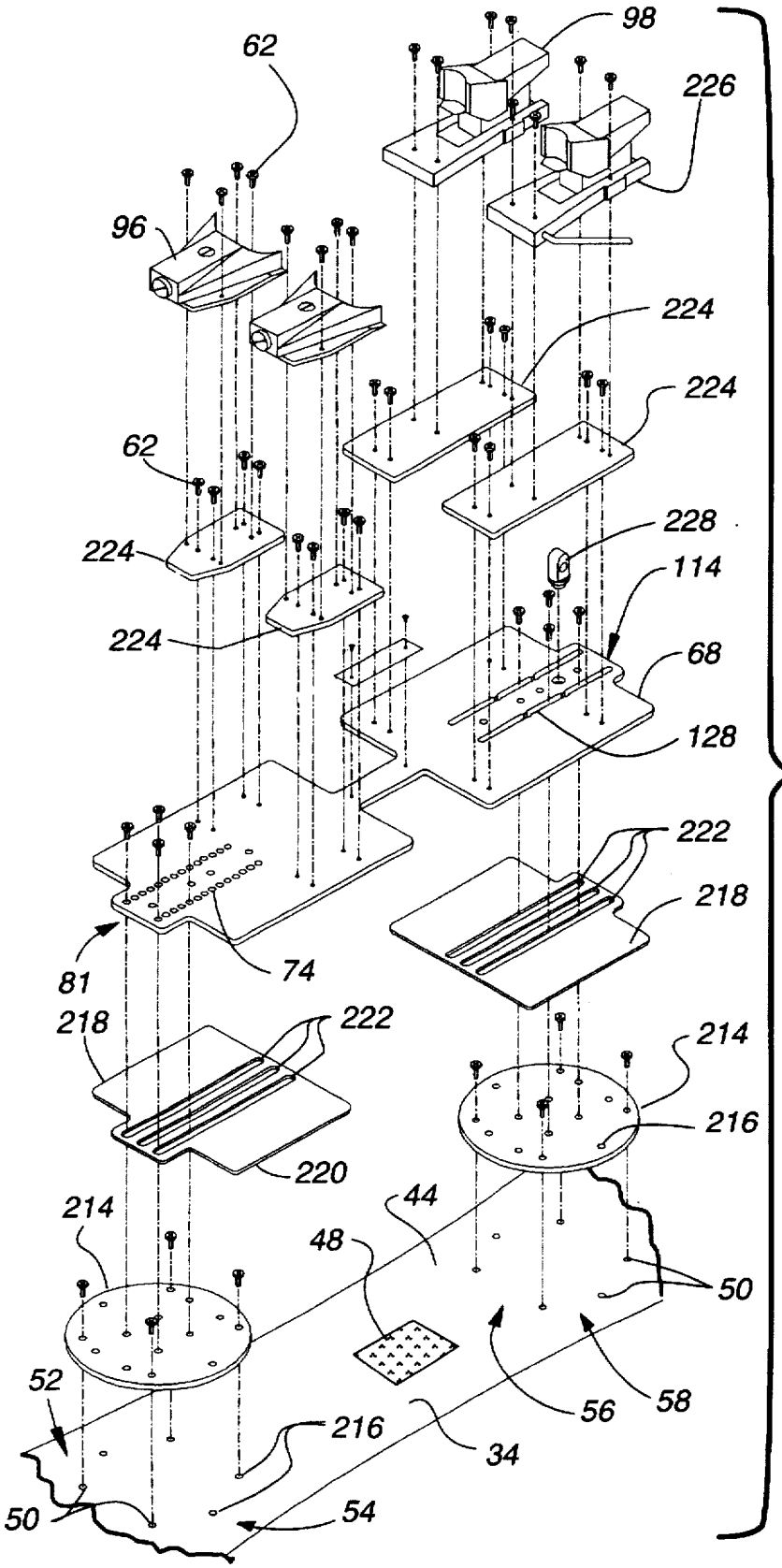
FIG. 14 is an exploded view of the binding mounting system of the present invention, illustrating a snowboard, conversion plate, risers, binding plate, binding adapters plate, and bindings.

The binding mounting system 32 can include a variety of separate attachments to facilitate the use of the system 32 on different types of snowboards 34. One such attachment is a conversion plate 214, as shown in FIG. 14. The conversion plate 214 is a flat circular rigid disk provided for use in mounting the binding plate 68 to a snowboard 34 having a unique group of binding mounting apertures 52, 56 that do not match the mounting structure 81 used on the binding plate 68. The conversion plate 214 mounts to the snowboard 34 by means of releasable fasteners 62, such as threaded screws. The threaded screws fit through apertures 216 patterned in the conversion plate 214 to correspond to the unique mounting aperture pattern 52, 56 used on the snowboard 34. The binding plate 68 in turn mounts to the conversion plate through the mounting structure 81 used in any of the embodiments of the binding plate 68. The bindings 72 are attached to the binding plate 68. By utilizing the conversion plate 214, the binding plate 68 can be used on virtually any snowboard 34.

Typically, snowboards 34 include a traction pad 48, as described above. They are generally mounted on the top surface 44 of the snowboard 34 at a central location along the length of the snowboard 34. The traction pad 48 has a thickness, which interferes with the direct application of the binding plate 68 to the top surface 44 of the snowboard 34. In order to avoid the interference of the traction pad 48 with the binding plate 68, a riser 218 is provided for placement between either or both ends 78, 80 of the binding plate 68 and the snowboard 34.

The riser 218 acts to lift the binding plate 68 and space it away from the snowboard 34 a sufficient distance to avoid interference with the traction pad 48. The riser 218 comprises a sheet of material, such as rubber, having a sufficient thickness 220 to space the binding plate 68 above the traction pad 48. The shape of each riser 218 ideally conforms with the shape of the end 78, 80 of the binding plate 68 under which it is placed.

The riser 218 includes a plurality of slots 222 formed through the riser pad 218 at locations corresponding to the mounting structure 81 of the particular binding plate 68 with which the riser pad 218 is used. For instance, as shown in FIG. 14, the riser 218 has three slots 222 corresponding with the three longitudinally oriented positions in which the releasable fasteners 62 are used to mount the binding plate onto the conversion plate 214 in FIG. 14. The releasable fasteners 62 used to attach the binding plate 68 to the conversion plate 214 or snowboard 34 pass through the binding plate 68 and through the riser 218 and engage either the conversion plate 214 or the snowboard 34.

Another benefit of the riser 218 is that it keeps the binding plate 68 from reducing, eliminating, or causing reverse camber in the snowboard 34. If the binding plate 68 is mounted directly to the snowboard 34, the stiffness of the binding plate 68, in addition to the position of the user's mass, acts to draw the snowboard 34 to the binding plate 68 and reduces, eliminates, or even reverses the camber. If reverse camber results, the upper surface 44 of the snowboard adapts a concave shape, while the lower surface is convex. The camber is intentionally placed in a snowboard 34 to provide better edge control and more general controllability. Eliminating the camber or reversing the camber is not desirable. As such, using the risers 218 allows the snowboard 34 to maintain its camber.

Another attachment is the ski binding adapter plates 224. Ski binding adapter plates 224 are used with the toe 96 and heel 98 portions of ski bindings 92, and lift the ski bindings 92 above the binding plate 68 a predetermined distance, typically equal to the thickness of the adapter plate 224. The ski binding adapter plates 224 are comprised of rigid material and have a shape substantially the same as the bottom 226 of the ski binding portion to which the adapter 224 is mounted. The ski binding 92 is thus attached to the ski binding adapter plate 224, and the binding adapter plate 224 is in turn attached by releasable fasteners 62 to the binding plate 68, which is in turn attached to either the conversion plate 214 or the snowboard 34 directly.

A leash attachment 228 is shown in FIGS. 14–17 and 19 mounted to the binding plate 68 behind and between the bindings 72. The leash attachment 228 provides a location to secure a leash (not shown). A leash is an elongated strap or cable having one end attachable to the leash attachment and the other end attachable to the user's leg so that the snowboard will not become uncontrollable if the user is released from the bindings.

Figure 15:
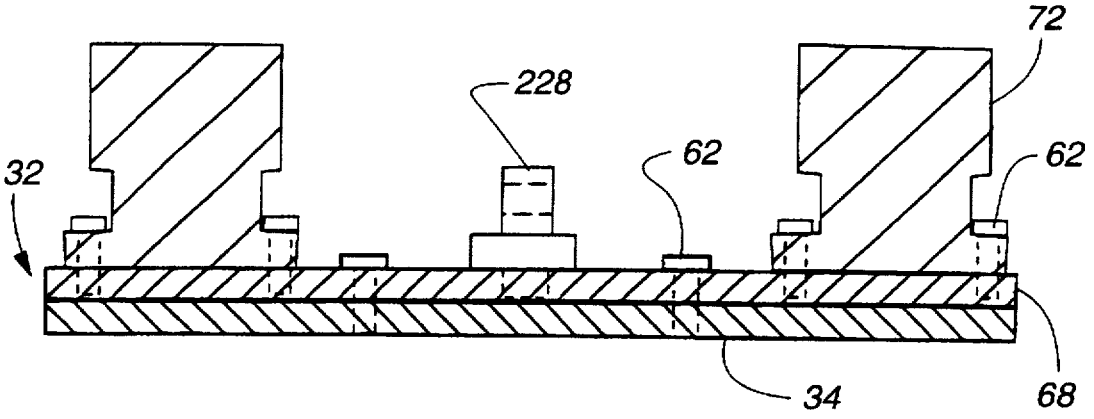
FIG. 15 is a representational section view of the binding mounting system, illustrating a snowboard, mounting plate, ski bindings, and leash attachment.

The structure of the mounting system 32 in its various embodiments is shown in representative sections in FIGS. 15 to 19. The attachment sequence for the most basic implementation of the present invention is shown in FIG. 15. The bindings are shown attached to the binding plate 68 by releasable fasteners 62, such as threaded screws. The binding plate 68 is then attached to the snowboard 34.

Figure 16:
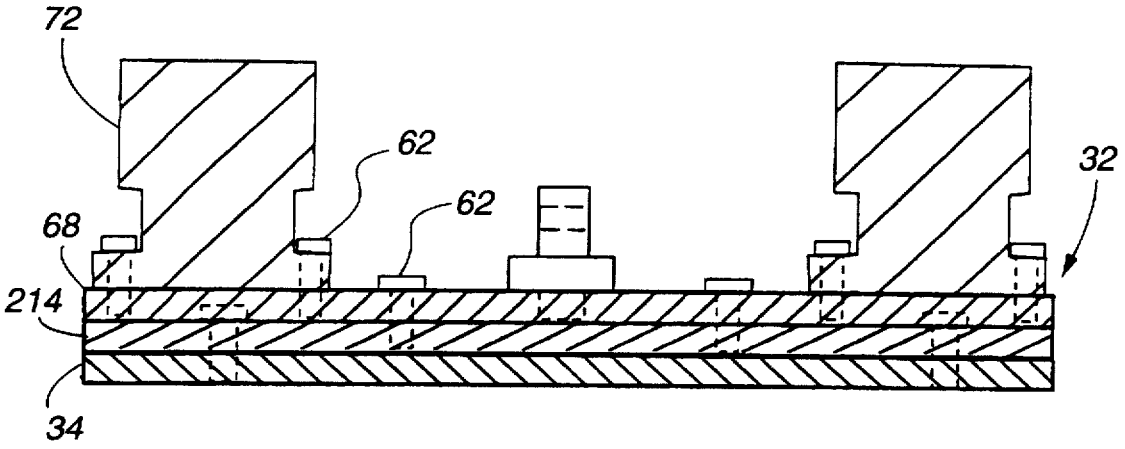
FIG. 16 is a representational section view of the snowboard binding mounting system, illustrating a snowboard, conversion plate, binding plate, ski bindings, and leash attachment.

A binding mounting system 32 using a conversion plate 214 is shown in FIG. 16. The bindings are attached to the binding plate 68 by releasable fasteners 62, and the binding plate 68 is in turn attached to the conversion plate 214 also by releasable fasteners 62. The conversion plate 214 is in turn releasably attached to the snowboard 34. Again, the conversion plate 214 is used where the binding mounting apertures 52, 56 on the snowboard is singular or unique and does not fit the mounting structure 81 of the binding plate 68.

Figure 17:
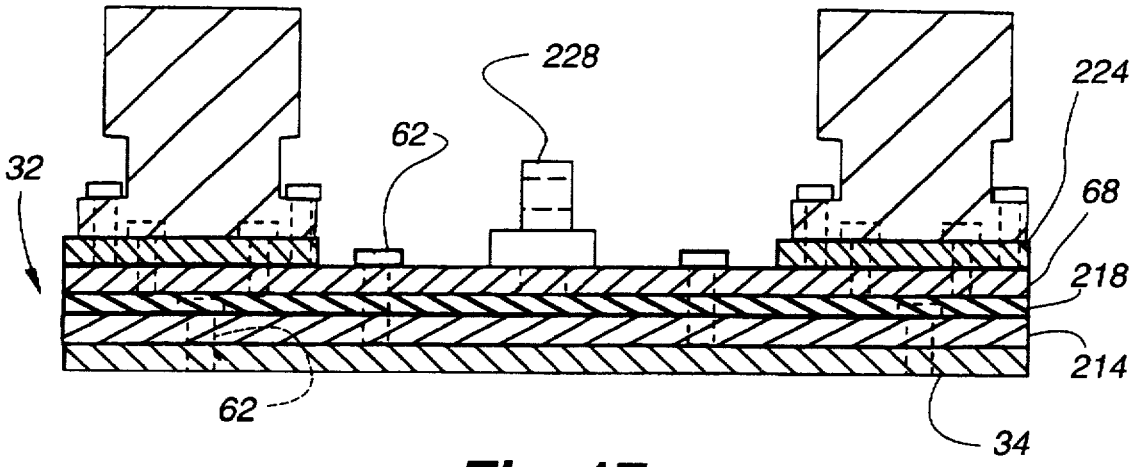
FIG. 17 is a representational section view of the snowboard binding mounting system, illustrating a snowboard, conversion plate, risers, binding plate, binding adapters plates, ski bindings, and leash attachment.

FIG. 17 portrays the binding mounting system 32 connection format where all parts of the system are in use. The bindings 72 are releasably attached to the binding adapters 224, which are releasably attached to the binding plate 68. The binding plate 68 is positioned on top of a riser 218, and releasable fasteners 62 pass through the binding plate 68 and the riser 218 and attach to the conversion plate 214. The conversion plate 214 is releasably fastened to the snowboard 34.

In FIG. 18, the bindings are attached to the binding plate 68 by releasable fasteners 62, and the binding plate 68 is then attached to the conversion plate 214 by the clamping action of the cassette 136, as described above. Releasable fasteners 62 pass through the cassette 136 and are threadably received in the threaded apertures in the conversion plate 214. The conversion plate 214 is releasably attached the snowboard 34.

Figure 19:
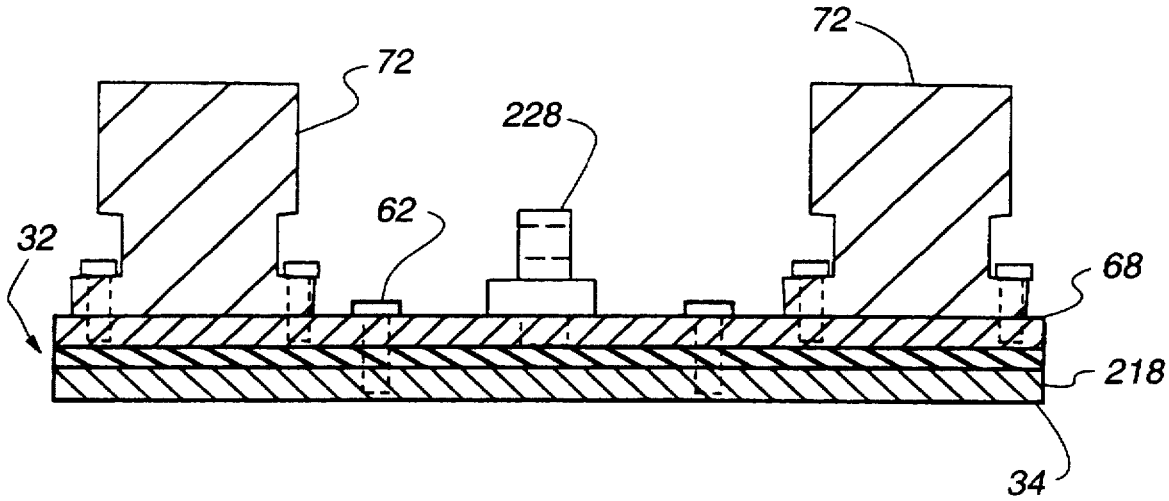
FIG. 19 is a representational section view of the snowboard binding mounting system, illustrating a snowboard, riser, binding plate, ski bindings, and leash attachment.

The binding plate 68 as used with a riser 218 is shown in FIG. 19. The bindings 72 are shown attached to the binding plate 68 by releasable fasteners 62. The binding plate 68 is shown as positioned over a riser 218 with releasable fasteners 62 passing through the binding plate 68 and riser pad 218, and being inserted and releasably attached to the snowboard 34.

Figure 20:
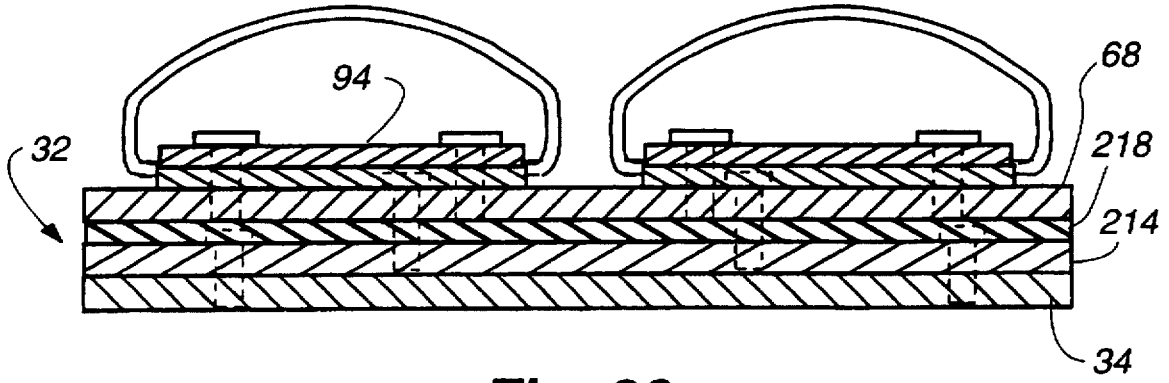
FIG. 20 is a representational section view of the binding mounting system, illustrating a snowboard, conversion plate, riser, binding plate, and snowboard plate bindings.

FIG. 20 discloses the structure of the binding plate 68 as used with the plate bindings 94. The plate bindings 94 are shown as being attached to the binding plate 68, which is positioned over the riser 218 and attached with the riser 218 to the conversion plate 214. The conversion plate 214 is releasably attached to the snowboard 34.

Although the present invention has been described with a certain degree of particularity, it is understood that changes in detail or structure may be made without departing from the spirit of the invention, as defined in the appended claims.

The invention claimed is:

1. A binding mounting system adapted to be used for releasably mounting bindings on a ski apparatus, the ski apparatus having a front end, a rear end, a top surface, and defining front and rear mounting locations, said binding mounting system comprising:

a. a binding plate having a front end and rear end;

b. a first mounting structure positioned adjacent to said front end of said binding plate;

c. a second mounting structure positioned adjacent to said rear end of said binding plate;

d. each of said first and second mounting structures further comprising:

a slot formed through said binding plate, said slot defining a first engagement surface;

a cassette defining an aperture therethrough and defining a second engagement surface, said cassette being positionable in said slot;

e. said binding plate being positionable on said top surface of said ski apparatus wherein when said plate is positioned on said ski apparatus said first mounting structure is positioned coextensive with said front mounting location of said ski apparatus, and said second mounting structure is positioned coextensive with said rear mounting location of said ski apparatus; and f. when said binding plate is positioned on said ski apparatus, said cassette is releasably attachable to said ski apparatus at each of the front and rear mounting locations, causing said first engagement surface to contact said second engagement surface to clamp said binding plate to said ski apparatus.

2. The binding system as defined in claim 1, wherein:

a. said binding plate has an upper surface;

b. said slot defines opposing laterally spaced longitudinal edges;

c. said cassette has upper and lower surfaces, and defines laterally opposing side edges;

d. said first engagement surface comprises a continuous rail extending inwardly from each of said opposing sides of said slot and defining an upwardly facing contact surface offset downwardly from said upper surface of said binding plate; and e. said second engagement surface comprises a continuous flange extending outwardly from said laterally opposing side edges of said cassette, and defining a downwardly facing contact surface offset upwardly from said lower surface.

3. The binding system as defined in claim 2, wherein said downwardly facing flange contact surface engages said upwardly facing rail contact surface when said cassette is positioned in said slot, to clamp said binding plate to said ski apparatus.

4. The binding system as defined in claim 3 wherein said flange and rail contact surfaces are correspondingly serrated to cause a mated engagement of said flange and rail contact surfaces when said cassette is positioned in said slot and secured to said ski apparatus.

5. The binding system as defined in claim 2, wherein:

a. said flange defines a thickness dimension;

b. said rail defines a thickness dimension;

c. said binding plate defines a thickness dimension;

d. the sum of said flange thickness dimension and said rail thickness dimension is less than said binding plate dimension; and e. a gap is formed between said flange contact surface and said rail contact surface when said cassette is positioned in said slot and secured to said ski apparatus, said gap allowing said binding plate to move forwardly and rearwardly with respect to said cassette and said ski apparatus as said ski apparatus bends, while restricting side-to-side movement of said binding plate on said ski apparatus.

6. The binding system as defined in claim 1, wherein:

a. said binding plate defines a longitudinal axis; and b. said slot is positioned longitudinally along the binding plate and is centered over said longitudinal axis.

7. A binding mounting system for releasably mounting bindings on a ski apparatus, the ski apparatus having a front end, a rear end, a top surface, and defining front and rear mounting locations, said binding mounting system comprising:

a. a binding plate having a front end and rear end;

b. a first mounting structure positioned adjacent to said front end of said binding plate and comprising a patterned plurality of apertures formed through said binding plate;

c. a second mounting structure positioned adjacent to said rear end of said binding plate and comprising a slot formed through said binding plate, said slot defining a first engagement surface, and a cassette defining an aperture therethrough and defining a second engagement surface, said cassette being positionable in said slot;

d. said binding plate being positionable on said top surface of said ski apparatus wherein when said binding plate is positioned on said top surface, said first mounting structure is positioned coextensive with said front mounting location of said ski apparatus, and said second mounting structure is positioned coextensive with said rear mounting location of said ski apparatus; and e. when said binding plate is positioned on said top surface, said front end of said binding plate is attachable to said front mounting location by releasable fasteners positioned through said patterned apertures and received in said front mounting location, and said rear end of said binding plate is attachable to said rear mounting location by releasable fasteners positioned through said aperture in said cassette and received in said rear mounting location, causing said first engagement surface to contact said second engagement surface to clamp said rear end of said binding plate to said ski apparatus.

8. The binding system as defined in claim 7, wherein:

a. said binding plate has an upper surface;

b. said slot has opposing laterally spaced longitudinal edges;

c. said cassette has upper and lower surfaces, and laterally opposing side edges;

d. said first engagement surface comprises a continuous rail extending inwardly from each of said opposing sides of said slot and defining an upwardly facing contact surface offset downwardly from said upper surface of said binding plate; and e. said second engagement surface comprising a continuous flange extending outwardly from said laterally opposing side edges of said cassette, and defining a downwardly facing contact surface offset upwardly from said lower surface.

9. The binding system as defined in claim 8, wherein said downwardly facing flange contact surface engages said upwardly facing rail contact surface when said cassette is positioned in said slot to clamp said rail to said ski apparatus to fix said binding plate in position on said ski apparatus.

10. The binding system as defined in claim 9 wherein said flange and rail contact surfaces are correspondingly serrated to cause a mated engagement of said flange and rail contact surfaces when said cassette is positioned in said slot and secured to said ski apparatus.

11. The binding system as defined in claim 8, wherein:

a. said flange defines a thickness dimension;

b. said rail defines a thickness dimension;

c. said binding plate defines a thickness, dimension;

d. the sum of said flange thickness dimension and said rail thickness dimension is less than said binding plate dimension; and e. a gap is formed between said flange contact surface and said rail contact surface when said cassette is positioned in said slot and secured to said ski apparatus, said gap allowing said binding plate to move forwardly and rearwardly with respect to said cassette and said ski apparatus as said ski apparatus bends, while restricting side-to-side movement of said binding plate on said ski apparatus.

* * * * *